US006619912B2

(12) United States Patent
Tiemann

(10) Patent No.: US 6,619,912 B2
(45) Date of Patent: Sep. 16, 2003

(54) TURBINE BLADE OR VANE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 26 days.

(21) Appl. No.: 10/116,873

(22) Filed: Apr. 5, 2002

(65) Prior Publication Data

US 2002/0155000 A1 Oct. 24, 2002

(30) Foreign Application Priority Data

Apr. 6, 2001 (EP) ..... 01108759

(51) Int. Cl.[7] ..... F01D 5/18

(52) U.S. Cl. ..... 415/115; 415/116; 416/97 R; 416/96 R; 29/889.7; 29/889.72

(58) Field of Search ..... 415/115, 116, 415/121.2, 169.1; 416/97 R, 96 R, 97 A, 96 A, 95; 29/889.7, 889.72, 889.721, 889.722

(56) References Cited

U.S. PATENT DOCUMENTS

| | | | | |
|---|---|---|---|---|
| 2,883,151 A | | 4/1959 | Dolida | |
| 3,623,825 A | | 11/1971 | Schneider | |
| 3,799,696 A | | 3/1974 | Redman | |
| 4,127,358 A | | 11/1978 | Parkes | |
| 4,177,010 A | | 12/1979 | Greaves et al. | |
| 4,453,888 A | | 6/1984 | Hovan et al. | |
| 4,529,357 A | | 7/1985 | Holland | |
| 4,596,281 A | | 6/1986 | Bishop | |
| 4,672,727 A | | 6/1987 | Field | |
| 5,291,654 A | | 3/1994 | Judd et al. | |
| 5,413,458 A | | 5/1995 | Claderbank | |
| 5,498,126 A | * | 3/1996 | Pighetti et al. | 415/115 |
| 5,599,166 A | | 2/1997 | Deptowicz et al. | |
| 5,669,759 A | | 9/1997 | Beabout | |
| 5,827,043 A | * | 10/1998 | Fukuda et al. | 415/115 |
| 6,347,923 B1 | * | 2/2002 | Semmler et al. | 416/97 R |

FOREIGN PATENT DOCUMENTS

DE 199 21 644 11/2000

* cited by examiner

*Primary Examiner*—Edward K. Look
*Assistant Examiner*—J. M. McAleenan

(57) ABSTRACT

The present invention relates to a process for producing a turbine blade or vane (13; 14), which has at least one chamber (22; 23, 24, 25) and an inlet (30; 31) for applying a cooling medium to the chamber (22; 23, 24, 25), at least one inlet (30) running at an angle with respect to a longitudinal axis (37) of the turbine blade or vane (13; 14). According to the invention, to form the inlet (30) a core (35) with a projection (33) is used, which projection is arranged at a distance from a mold (40). Therefore, after removal from the mold the inlet (30) of the turbine blade or vane (13; 14) is closed, and is opened up by machining. The invention also relates to a turbine blade or vane, in particular for a gas turbine (10), which has at least one chamber (22; 23, 24, 25) and at least one inlet (30; 31) for applying a cooling medium to the chamber (22; 23, 24, 25). The inlet (30) runs at an angle with respect to a longitudinal axis (37) of the turbine blade or vane (13; 14) and runs substantially parallel to a direction of flow (15) of a medium through the turbine (10). It is therefore possible for cooling medium to be introduced in the axial direction of the turbine (10).

17 Claims, 3 Drawing Sheets

TURBINE BLADE OR VANE

CROSS-REFERENCE TO RELATED APPLICATIONS

This application claims priority to EP/01108759.0, filed Apr. 6, 2001 under the European Patent Convention and which is incorporated by reference herein in its entirety.

FIELD OF THE INVENTION

The present invention relates to a process for producing a turbine blade or vane, and more specifically for producing a turbine blade or vane in for a gas turbine engine.

BACKGROUND OF THE INVENTION

The subject matter of the present invention relates to a process for producing a turbine blade or vane, which has at least one chamber and at least one inlet for applying a cooling medium to the chamber, at least one inlet running at an angle with respect to a longitudinal axis of the turbine blade or vane. It also relates to a turbine blade or vane, in particular for a gas turbine, which has at least one chamber and at least one inlet for applying a cooling medium to the chamber.

A process of manufacturing a turbine blade or vane of are described in U.S. Pat. No. 5,599,166 ('166). In the '166 patent the described turbine blade or vane has two chambers which are separate from one another, run in meandering form and are each connected to an inlet for applying a coolant. The two inlets run substantially parallel to the longitudinal axis of the turbine blade or vane.

U.S. Pat. No. 5,413,458 ('458) describes another turbine blade or vane, which likewise has at least one chamber for applying a cooling medium. The cooling medium of the '458 patent is in this case supplied in a direction which is likewise substantially parallel to the longitudinal axis of the turbine blade or vane.

A drawback of the known prior art turbine blades or vanes and production processes is the forced fixing of the direction of the inlet. The turbine blades or vanes generally have an airfoil profile, around which a medium passing through the turbine flows. A platform is used to fix the blade or vane to a housing or a rotor. In the known turbine blades or vanes, the cooling medium must first of all flow through the platform before entering the airfoil profile. This means that the platform and the airfoil profile always have to be cooled with the same cooling medium, in particular with a cooling medium which is at the same pressure and the same temperature. Targeted cooling of relatively highly stressed parts of the turbine blade or vane is not possible.

Therefore, it is an object of the present invention to provide a process for producing a turbine blade or vane and a turbine blade or vane itself which allow targeted application of a cooling medium.

SUMMARY OF THE INVENTION

According to the invention, this object is achieved, in a process of the type described in the introduction, by the fact that, to form the inlet, a core with a projection is used, and the projection is arranged at a distance from a mold, so that the inlet of the turbine blade or vane is closed after removal from the mold, and in that machining is carried out in order to open up the inlet. In the turbine blade or vane according to the invention, it is provided that the inlet runs at an angle with respect to a longitudinal axis of the turbine blade or vane and runs substantially parallel to a direction of flow of a medium through the turbine.

The core or cores used to produce the turbine blade or vane is/are, as previously described, inserted into and held in the mold. The cores are not supported in the mold by means of the projection. Therefore, the cores can move during the casting operation, as is the case in the known processes. The core position is not influenced by contact between the projection and the mold.

The invention alternatively also provides an inlet running substantially parallel to the longitudinal axis of the turbine blade or vane. The inlet is provided which is arranged at an angle to the longitudinal axis and runs substantially parallel to a direction of flow of the medium through the turbine. This inlet allows targeted application of a cooling medium to highly stressed parts of the turbine blade or vane.

Advantageous configurations and refinements will emerge from the dependent claims.

In the process according to the invention, a second inlet is preferably provided substantially parallel to the longitudinal axis of the turbine blade or vane. The two inlets can then be acted on by different cooling media. This difference may reside in particular in the pressure and/or temperature of the coolant supplied in each case. Therefore, the result is targeted, highly efficient cooling of individual parts of the turbine blade or vane.

It is possible to provide a plurality of projections and, accordingly, a plurality of inlets of this type. The inlets may be arranged on a front edge, a rear edge or both edges of the turbine blade or vane. The targeted arrangement allows optimum cooling of the turbine blade or vane.

According to an advantageous configuration, the inlet which runs at an angle to the longitudinal axis is of tapered design, and more specifically conical. It then has a relatively large cross section at it opening. Therefore, the cooling medium can be passed to the inlet at relatively low pressure and is compressed as it flows in. The inlet is designed in such a way that flow losses are minimized.

The inlet running perpendicular to the longitudinal axis of the turbine blade or vane means that there is sufficient space available. There is no need for a complicated arrangement, which weakens the material, of the two inlets approximately parallel to the longitudinal axis of the turbine blade or vane.

The inlet running in the axial direction is advantageously arranged between a platform and an airfoil profile of the turbine blade or vane. Therefore, the cooling medium which is supplied via this inlet can pass directly into chambers of the airfoil profile. Then, the second inlet, which runs substantially parallel to the longitudinal axis, is used to cool the platform.

The division of the cooling medium, which is provided for according to the invention, is advantageous in particular in the case of a turbine blade or vane which has at least two chambers. The first chamber is then in communication with the first inlet and the second chamber is in communication with the second inlet. In this case, the first chamber is advantageously arranged in the region of a front edge of the turbine blade or vane.

This chamber arranged in the region of the front edge generally has a higher demand for cooling than the second chamber. If the front edge is provided with openings through which the cooling medium can escape, it is also necessary to apply a cooling medium which is at a higher pressure. The reason for this is that the cooling medium, to flow out of the first chamber, has to overcome the jet pressure of the medium flowing through the turbine. According to the invention, the first chamber can now be acted on by a cooling medium which is at a higher pressure than that for the second chamber, via the first inlet. Therefore, this first chamber can deliberately be cooled more extensively. This level of cooling is not necessary for the second chamber. Therefore, the consumption of cooling medium can be optimized, and, as a result, the overall efficiency can be increased. As an alternative or in addition, targeted cooling of the rear edge is also possible.

BRIEF DESCRIPTION OF THE DRAWINGS

The invention is explained in more detail below with reference to exemplary embodiments, which are diagrammatically illustrated in the drawing. For similar and functionally identical components, the same reference numerals are used throughout. In the drawings.

DESCRIPTION OF THE PREFERRED EMBODIMENTS

Figure 1:
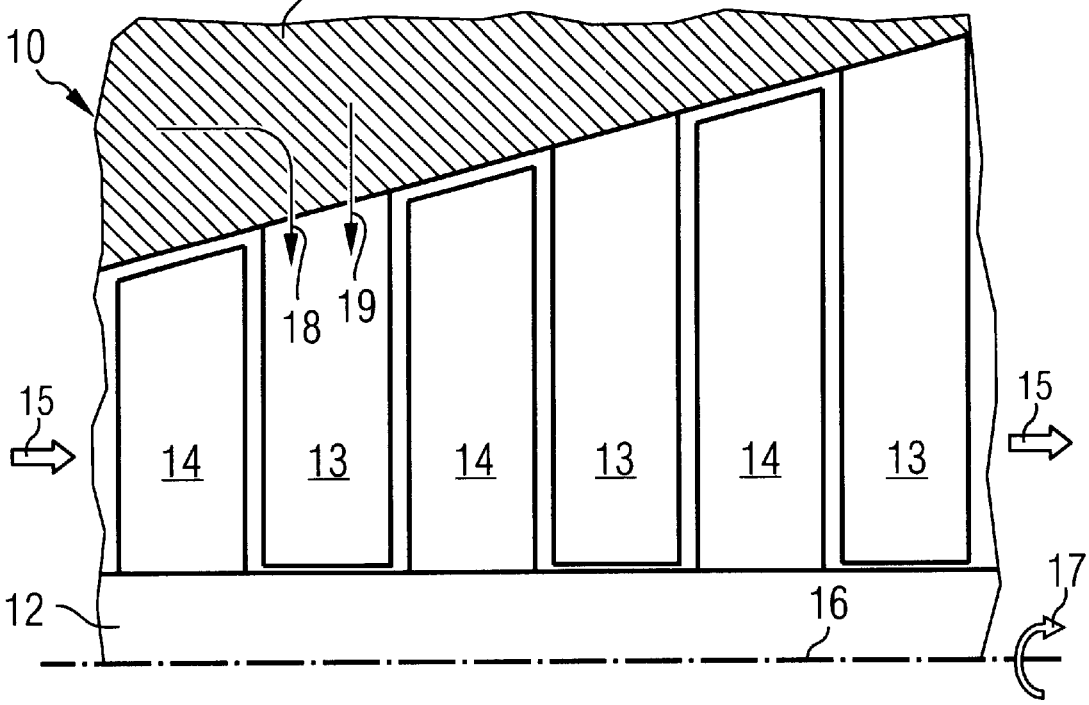
FIG. 1 shows a diagrammatic longitudinal section through a gas turbine.

FIG. 1 shows a diagrammatic longitudinal section through a gas turbine 10 having a housing 11 and a rotor 12. Rows of guide vanes 13 are provided on the housing 11, and rows of rotor blades 14 are provided on the rotor 12. A combusted hot gas flows through the gas turbine 10 in the direction indicated by arrow 15, causing the rotor 12 to rotate about its axis of rotation 16 in the direction indicated by arrow 17. Cooling is provided by a cooling medium which is supplied in the direction indicated by the arrows 18, and 19. For the sake of simplicity, this supply is only illustrated for a guide vane 13. However, the present invention is not restricted to a guide vane 13, but rather may also be used for a rotor blade 14.

Figure 2:
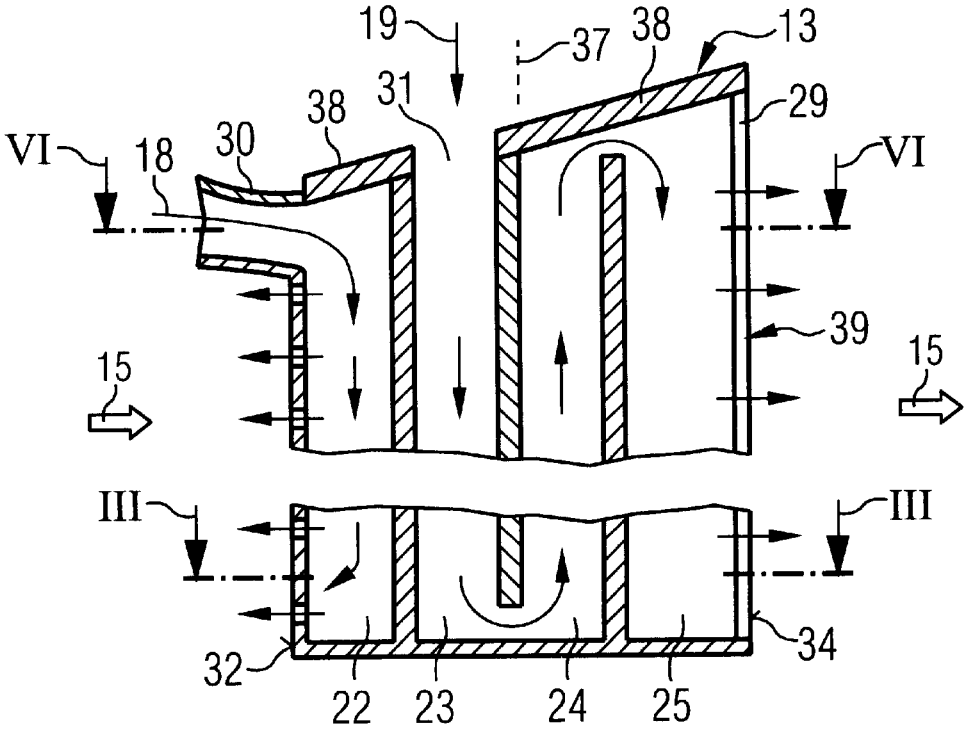
FIG. 2 shows a longitudinal section through a turbine guide vane on line II—II in FIG. 3.
Figure 3:
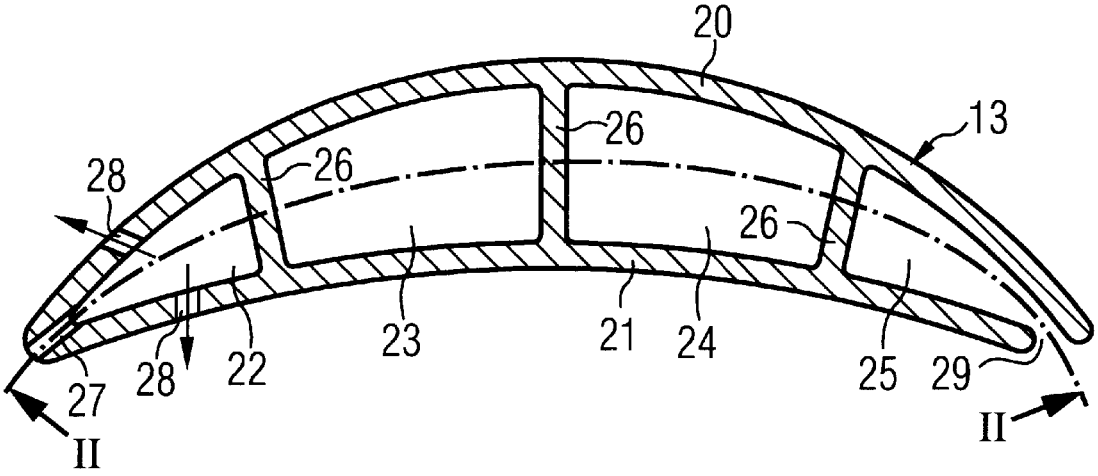
FIG. 3 shows a cross section through a turbine guide vane on line III—III in FIG. 2.

Referring to FIGS. 2 and 3, FIG. 2 shows a longitudinal section and FIG. 3 a cross section through a guide vane 13. The guide vane 13 has a platform 38 for securing it to the housing 11 and an airfoil profile 39, around which the hot gas flows. This airfoil profile 39 is formed by a suction-side wall 20 and a pressure side-wall 21. A first chamber 22 and three further chambers 23, 24, 25, which are in communication with one another, are provided between the walls 20, 21. The individual chambers 22, 23, 24, 25 are separated from one another by walls 26. Covering is provided by a subsequently fitted platform 38, for example in the form of a metal sheet or a perforated metal sheet. The first chamber 22 is in this case arranged at a front edge 32 of the airfoil profile 39 of the guide vane 13.

To apply a cooling medium to the chamber 22, there is a projection 30 which defines an inlet opening for the cooling medium. A cooling medium is applied to the chamber 23 via openings 31 and successively flows through the first chamber 23 and then the chambers 24, 25. The openings 34 likewise defines an outlet. The cooling medium is supplied to the chamber 22 approximately perpendicular to a longitudinal axis 37 of the guide vane 13, in the direction indicated by arrow 18. The chamber 23 is acted on approximately perpendicular to the longitudinal axis, in the direction indicated by arrow 19. The projection 30 allows an inlet to be formed between the platform 38 and the airfoil profile 39.

The chamber 22 is acted on by cooling medium which is at a higher pressure than the chamber 23. The reason for this is that this chamber 22 is located in the region of the highly stressed front edge 32 of the guide vane 13. The higher pressure level is required in particular when the chamber 22 is provided with a row of openings 27, 28. The cooling medium can emerge through these openings and form a cooling film which extends along the walls 20, 21 in the region of the front edge 32. Since the hot gas flows directly on to the front edge 32, it is necessary to overcome not only the static pressure of the hot gas but also, in addition, its dynamic pressure.

A gap 29 is provided in the region of a rear edge 34 of the guide vane 13. The cooling medium supplied to the chamber 23 escapes through this gap. Since the gap 29 is acted on only by the static pressure of the hot gas, a lower pressure of the cooling medium is sufficient to cool the chambers 23, 24, 25.

Therefore, in the turbine blade or vane 13, 14 according to the invention, the more highly stressed chamber 22 is cooled by cooling medium which is at a higher pressure than that used for the further chambers 23, 24, 25. A dedicated inlet opening, in the form of the projection 30, is provided for this coolant. This inlet 30 runs at an angle to the longitudinal axis 37 of the turbine blade or vane 13, 14 and is arranged between the platform 38 and the airfoil profile 39. It is of conical design and has a form which is desirable in terms of fluid dynamics.

A dedicated inlet 31 is provided for applying the cooling medium to the further chambers 23, 24, 25. The cooling medium is supplied substantially parallel to the longitudinal axis 37 via this inlet opening 31.

Figure 4:
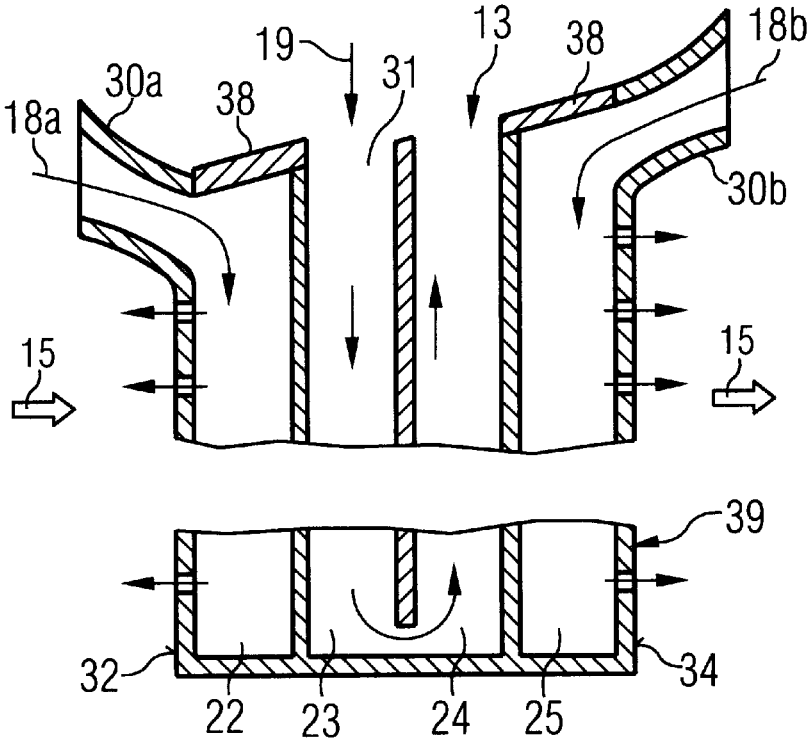
FIG. 4 illustrates a further exemplary embodiment in a view which is similar to that shown in FIG. 2.

Now referring to FIG. 4, there is shown a further exemplary embodiment of a turbine vane 13 in a view which is similar to that shown in FIG. 2. This turbine vane 13 has two projections 30*a*, 30*b*, one of which is arranged on the front edge 32 and one of which is arranged on the rear edge 33. Both projections 30*a*, 30*b* are designed to be conical and desirable in terms of fluid dynamics. The cooling medium supplied via the projections 30*a*, 30*b* in each case acts on chambers 22, 25 which are located in the region of the front edge 32 or the rear edge 34. The central region having the chamber 23, 24 is acted on via an inlet 31 which is substantially parallel to the longitudinal axis 37.

Figure 5:
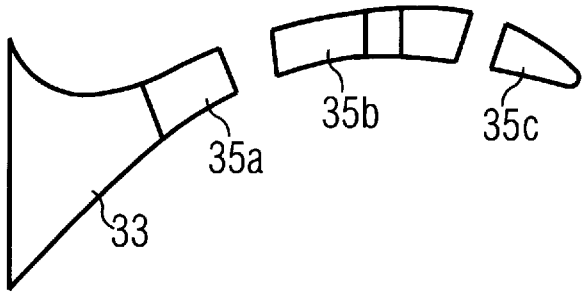
FIG. 5 shows a plan view of an arrangement of cores for producing the turbine vane shown in FIG. 2.
Figure 6:
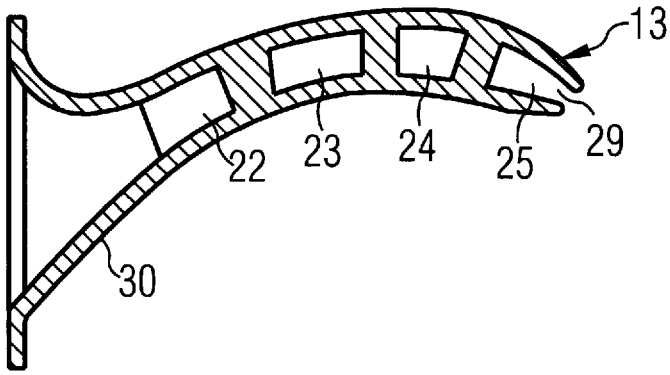
FIG. 6 shows a section on line VI—VI in FIG. 2.

Now referring to FIG. 5, there is shown a plan view of the core including sections 35*a*, 35*b*, 35*c* used to produce the turbine vane 13 illustrated in FIG. 2. FIG. 6 shows a section on line VI—VI in FIG. 2 through this turbine vane 13. The projection 33 of the core 35*a*, 35*b*, 35*c* tapers, so that the projection 30 of the turbine vane 13, which is used as the inlet, also tapers. The inner side of the projection 30 is designed to be smooth, so that the flow resistance of is minimized.

Figure 7:
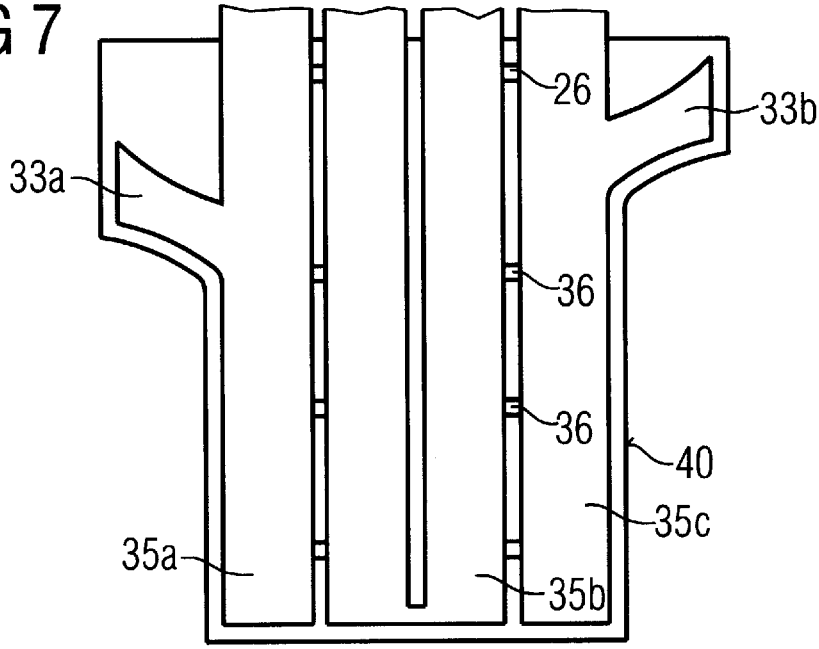
FIG. 7 diagrammatically depicts a core for producing a turbine blade or vane.

FIG. 7 diagrammatically depicts a multipart core 35*a*, 35*b*, 35*c* in a mold 40. The individual parts 35*a*, 35*b*, 35*c* are fixed relative to one another by means of connecting pins 36. The core 35*a*, 35*b*, 35*c* projects beyond the mold 40, where it is held. The resulting openings in the turbine blade or vane 13, 14 are subsequently closed off by the platform 38.

The projections 33*a*, 33*b* are not in contact with the mold 40. Therefore, the core 35*a*, 35*b*, 35*c* can move during casting, as is known to one skilled in the art.

To produce the turbine blade or vane 13, 14 according to the invention, the core 35*a*, 35*b*, 35*c* illustrated is introduced into the mold 40 and the mold 40 is closed. After the material has been introduced and cooled, the mold 40 is opened and the turbine blade or vane 13, 14 is removed together with the core 35*a*, 35*b*, 35*c*. Then, the core 35*a*, 35*b*, 35*c* is removed, for example by leaching. The projection 30 of the turbine blade or vane 13, 14 is then initially still closed. It is opened up by a suitable machining operation. The finished turbine blade or vane 13, 14 then provides an inlet for the cooling medium both in the axial direction at an angle to the longitudinal axis 37 and parallel to the longitudinal axis 37.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A method of producing a turbine blade or vane having at least one chamber and at least one inlet for applying a cooling medium to the chamber wherein the chamber has a plurality of exit holes, at least one other inlet running at an angle with respect to a longitudinal axis defined by the turbine blade or vane, comprising the steps of;

providing a mold in the form of turbine blade or vane;

providing a core inside the mold having a projection being arranged at a distance from the mold to form a cooling inlet;

forming the blade or vane in the mold and core;

removing the blade or vane from the mold; and machining the projection in order to define an opening in the cooling inlet.

2. The method as claimed in claim 1, wherein the core having a second projection being arranged at a distance from the mold to form a second cooling inlet and machining the second projection in order to define and opening in the second cooling inlet.

3. A turbine blade or vane having walls vane having walls on the leading and trailing edge and a longitudinal axis, for a gas turbine with a direction flow of medium there through, comprising;

at least one chamber defined by the walls of the turbine blade or vane; and at least one inlet defined by the walls for applying a cooling medium to the chamber with the inlet running at an angle with respect to the longitudinal axis of the turbine blade or vane and running substantially parallel to a direction of flow of a medium through the turbine, wherein the cooling medium discharges through the leading edge or trailing edge.

4. The turbine blade or vane as claimed in claim 3, wherein the inlet being arranged on a front edge of the turbine blade or vane.

5. The turbine blade or vane as claimed in claim 4 wherein the inlet runs approximately perpendicular to the longitudinal axis of the turbine blade or vane.

6. The turbine blade or vane as claimed in claim 4 wherein the inlet is arranged between a platform and an airfoil profile of the turbine blade or vane.

7. The turbine blade or vane as claimed in claim 3, wherein the inlet being arranged on a back edge of the turbine blade or vane.

8. The turbine blade or vane as claimed in claim 7 wherein the inlet runs approximately perpendicular to the longitudinal axis of the turbine blade or vane.

9. The turbine blade or vane as claimed in claim 7 wherein the inlet is arranged between a platform and an airfoil profile of the turbine blade or vane.

10. The turbine blade or vane as claimed in claim 3 wherein the inlet is of tapered design.

11. The turbine blade or vane as claimed in claim 3 further comprising a second inlet defined by the walls which runs substantially parallel to the longitudinal axis of the turbine blade or vane.

12. The turbine blade or vane as claimed in claim 11 further comprising a second chamber defined by the walls, the first chamber being in communication with the first inlet and a second chamber being in communication with the second inlet.

13. The turbine blade or vane as claimed in claim 12, wherein the first chamber being positioned at a front edge of the turbine blade or vane.

14. The turbine blade or vane as claimed in claim 13, wherein the first chamber being positioned at a back edge of the turbine blade or vane.

15. A turbine blade or vane having walls vane having walls on the leading and trailing edge and defining a longitudinal axis, for a gas turbine with a direction flow of medium there through, comprising;

a first chamber defined by the walls of the turbine blade or vane;

a second chamber defined by the walls of the turbine blade or vane being located in parallel relationship to the first chamber;

a first inlet defined by the walls for applying a cooling medium to the first chamber with the inlet running at an angle with respect to the longitudinal axis of the turbine blade or vane and running substantially parallel to a direction of flow of a medium through the turbine, wherein the cooling medium discharges through the leading edge; and a second inlet defined by the walls for applying a cooling medium to the second chamber with the inlet running at an angle with respect to the longitudinal axis of the turbine blade or vane and running substantially parallel to a direction of flow of a medium through the turbine.

16. The turbine blade or vane as claimed in claim 15 wherein the turbine blade or vane also having a platform, further comprising;

a third chamber defining by the wall of the turbine blade or vane located in to parallel relationship with the first and second chambers; and a third inlet defined by the walls and the platform for applying a cooling medium to the third chamber with the inlet running in conjunction with the longitudinal axis of the turbine blade or vane and running substantially perpendicular to a direction of flow of a medium through the turbine.

17. The turbine blade or vane as claimed in claim 16 wherein the first chamber is located at a front edge, the second chamber is located at a back edge, and the third chamber is located between the first and third chambers of the blade or vane.

* * * * *